US007034664B2

(12) United States Patent
Chen et al.

(10) Patent No.: US 7,034,664 B2
(45) Date of Patent: Apr. 25, 2006

(54) ALERTING SYSTEM USING A COMMUNICATION PROTOCOL

(75) Inventors: Wen Chin Chen, Kee Long (TW); Kun Li Chen, Kee Long (TW)

(73) Assignee: IQ Group SDN BHD, Penang (MY)

( * ) Notice: Subject to any disclaimer, the term of this patent is extended or adjusted under 35 U.S.C. 154(b) by 81 days.

(21) Appl. No.: 10/769,029

(22) Filed: Jan. 29, 2004

(65) Prior Publication Data

US 2005/0104726 A1 May 19, 2005

(30) Foreign Application Priority Data

Nov. 14, 2003 (MY) ..... PI 20034374

(51) Int. Cl.
*G08B 3/00* (2006.01)

(52) U.S. Cl. ..... 340/328; 340/539.1; 340/5.64

(58) Field of Classification Search ..... 340/328, 340/5.64, 5.65, 539.1, 815.4, 384.1
See application file for complete search history.

(56) References Cited

U.S. PATENT DOCUMENTS 5,365,214 A 11/1994 Angott et al.
5,864,297 A * 1/1999 Sollestre et al. ..... 340/5.23
5,952,933 A 9/1999 Issa et al.
6,212,359 B1 * 4/2001 Knox ..... 725/135
RE37,986 E * 2/2003 Heitschel et al. ..... 700/90
6,700,479 B1 * 3/2004 Birchfield ..... 340/426.14
6,791,467 B1 * 9/2004 Ben-Ze'ev ..... 340/825.69

FOREIGN PATENT DOCUMENTS

EP 1178453 A2 2/2002

* cited by examiner

*Primary Examiner*—Toan N. Pham
(74) *Attorney, Agent, or Firm*—Wolf, Greenfield & Sacks, P.C.

(57) ABSTRACT

A general short-range remote control alerting system consists of at least one transmitter or encoder device in communication with at least one receiver or decoder device. Each transmitter or encoder device has a factory pre-set unique identification (ID) code. The receiver or decoder device utilizes a memory device, the memory of which will not change due to power supply interruption and can be read or written or re-written to store ID codes from the various transmitters or encoder devices. The transmitter or encoder device transmits ID code to the receiver or decoder device, and upon matching, the receiver or decoder device causes pre-defined functions to be performed, such as a musical tune to be played or a light to be activated or de-activated. A communication protocol realizing the above system is also disclosed.

The present invention can be applied to doorbells, security lights, home controls and security alarm systems.

8 Claims, 6 Drawing Sheets

ALERTING SYSTEM USING A COMMUNICATION PROTOCOL

TECHNICAL FIELD

The present invention relates to a general short-range remote control alerting system using a communication protocol. Particularly, the alerting system relates to encoder device(s) having factory pre-set identification (ID) code(s), using a four quadric or higher communication protocol, and a decoder device with a memory device, which is automatically or manually programmed to store and verify the ID code(s) from and respond to the encoder device(s).

BACKGROUND OF THE INVENTION

U.S. Pat. No. 5,365,214 discloses a musical wireless alerting system. It includes several detectors which transmit radio-frequency (RF) signals to a common receiver. The detectors include manual switches thereon to allow manual selection of a song or melody. The selection is coded in the form of an audio code which is transmitted to the receiver. The receiver detects any RF transmissions and verifies that the received transmissions are identifiable with the receiver. Upon verification, the receiver reads the audio code and compares same to a plurality of stored songs or tunes within memory for transmission to a speaker which plays the song or tune. Each of the detectors may sense different predefined conditions and indicate different audible indications to be played. The detectors may sense conditions such as opening of the door or depression of a doorbell.

Prior art teaches a general short-range remote control device which comprises an encoder or a transmitter with an encoder (herein called encoder device) and a decoder or a receiver with a decoder (herein called the decoder device). The encoder device is mainly designed to provide a common house code and unique data codes to allow the decoder device to respond and function accordingly. The house code is normally achieved by a dual in-line package (DIP) switch with eight positions to provide 256 different combinations. For recognition, both the encoder and the decoder devices should match their house code, or else the decoder device would not be able to respond to the command of the encoder device.

As mentioned above, since the existing prior art can only provide limited number of house codes to choose from, it is difficult to avoid interference from consumer's neighbors who are also using the invention. It could be troublesome to change the house code, because the consumer would not know the codes of their neighbors. Changes need to be made on all encoder and decoder devices. Furthermore, an intruder with the same product can easily interfere this remote control device by changing the house code one by one and it will trouble and inconvenient the consumer(s).

The invention introduces a new concept to provide one unique identification (ID) code for each encoder device which is pre-set or built-in during manufacturing. Through an automatic or manual learning process, the receiver can memorize many ID codes in the electrically erasable programmable read-only memory (EEPROM) integrated circuits (IC) or flash read-only memory (ROM). Once memorized, the contents inside these memory devices will not be lost or changed, even if there is power supply interruption. The receiver will be free from interference from a different transmitter, since its ID code does not match and will not be recognized.

This new concept teaches a separate unique ID code for each encoder device. There must be a wide choice of ID codes for hundreds of thousands of encoder devices, in order to avoid interference. This is supported by applying a four quadric or higher communication protocol coding arrangement. The arrangement allows for increased transmission power as regulated by Federal Communications Commission (FCC) due to low average on period per duty cycle.

SUMMARY OF THE INVENTION

An alerting system consists of at least one transmitter or encoder device in communication with at least one receiver or decoder device. The transmitter or encoder device has a factory pre-set built-in fixed unique ID code. The ID codes of the various transmitters or encoder devices are different, to avoid interference. There are substantially large number of ID code combinations to choose from. The receiver or decoder device is operable by a receiver circuit, and a microprocessor interfaced with an EEPROM or flash ROM. These ROMs are used to store the ID code(s) of the transmitter(s) or encoder device(s). The receiver of the alerting system would respond with pre-defined function(s), upon successful matching of the ID code from an encoder device with the code stored in the EEPROM or the flash ROM. A four quadric or higher communication protocol realizing the above system is also disclosed. The present invention can be applied to a general short-range remote control alerting system utilizing RF link to operate devices such as doorbells, security lights, home controls and security alarm systems.

DETAILED DESCRIPTION

According to the present invention, an alerting system consists of at least one transmitter or encoder device in communication with at least one receiver or decoder device. The present invention can be applied to a general short-range remote control alerting system utilizing RF link to operate devices such as doorbells, security lights, home controls and security alarm systems.

Each transmitter or encoder device is operable by an application specific integrated circuit (ASIC) assisted transmitter circuit, with a factory pre-set built-in fixed unique ID code. There is a wide choice of ID codes to choose from, for the various transmitters or encoder devices. The receiver or decoder device is operable by a receiver circuit, and a microprocessor which is interfaced with an EEPROM or flash ROM. These ROMs are used to store the ID code(s) of the transmitter(s) or encoder device(s). The receiver of the alerting system would respond with pre-defined function(s), upon successful matching of the ID code from an encoder device with the code stored in the EEPROM or the flash ROM. The pre-defined functions include playing a musical tune, activating or de-activating a light.

Preferably, each transmitter or encoder device is given a separate and unique ID code through the ASIC. The ID code is set during IC manufacturing by controlling a serial number in sequence and associating with electrified test probes. These probes, which normally are used for Go/No Go validation, fuse the circuit in the ASIC with the ID code. The ID code or address code employs a four quadric or higher communication protocol. Once set, the ID code does not change even if there is power supply interruption. Without these test probes, even the purchaser of the invention cannot change this ID code.

In addition to the above described ASIC approach, the factory pre-setting of fixed unique ID code for each transmitter or encoder device can also be achieved with a microprocessor. The microprocessor can be an one-time-programmable (OTP) type. Alternatively, the microprocessor can be built-in with a flash ROM or with an external EEPROM, the contents in the memory device will not be lost or changed due to any power supply interruptions.

Figure 1:
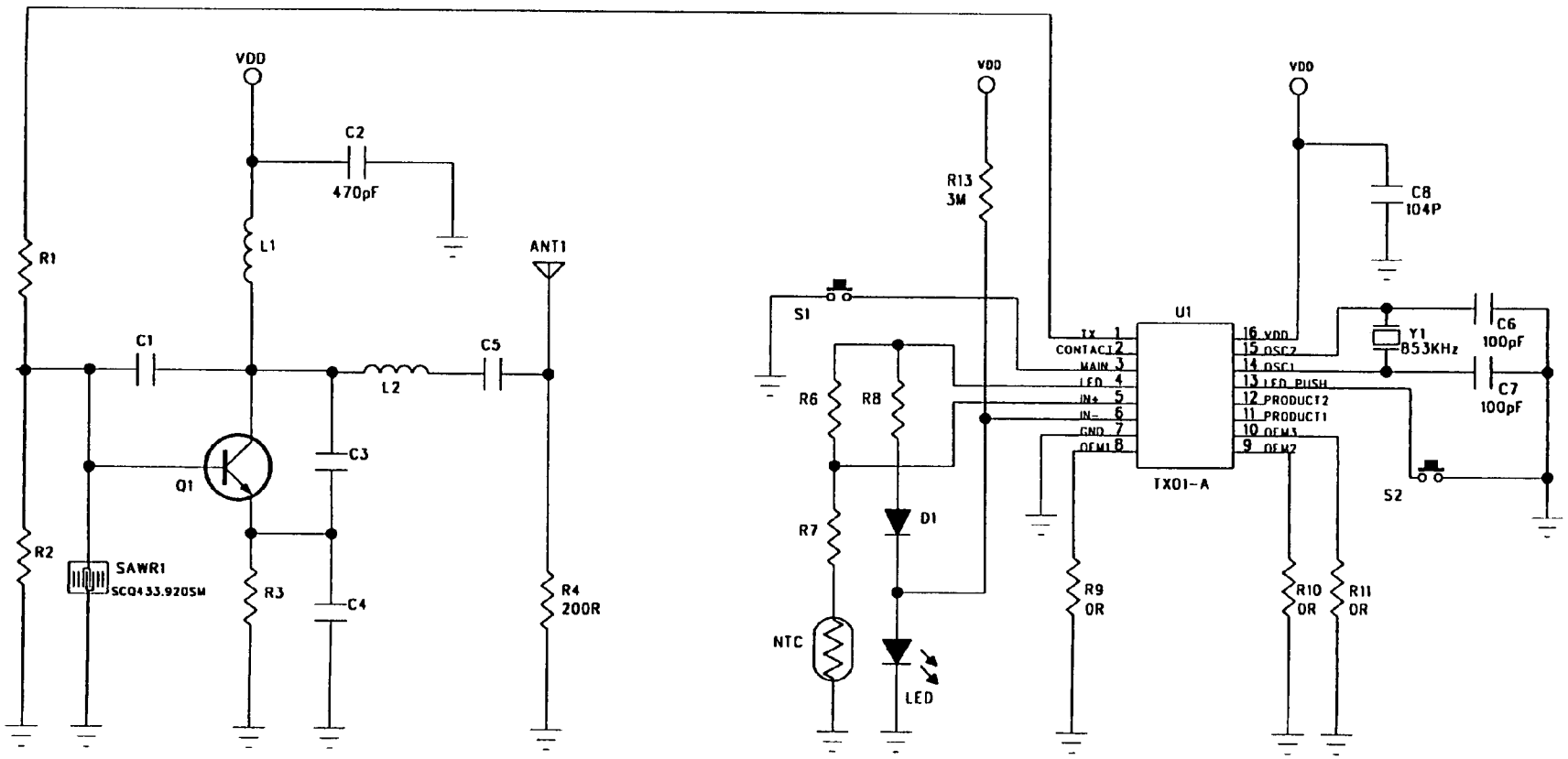
FIG. 1 shows a circuit diagram of light emitting diode (LED) push transmitter according to the present invention.

Referring to FIG. 1, an ASIC (U1) provides all the functions and acts as a transmitter or encoder device to generate a 1.2 seconds data streams when it is activated by switch S1. The 1.2 seconds data streams once available will be delivered to RF transmission circuit Q1 and then into the air as the remote control signal for receiver. The duration of each data stream is 100 ms, which means that there will be 12 data streams within the 1.2 seconds transmission period. For the time being, the LED lights through relay R8 and diode D1 as indication of transmission when the ASIC (U1) delivers the data streams.

Figure 2:
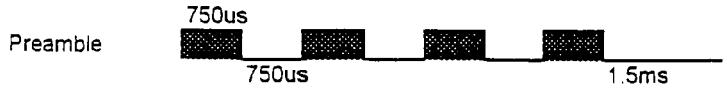
FIG. 2 shows the preamble of the transmission protocol used by the present invention.
Figure 3:
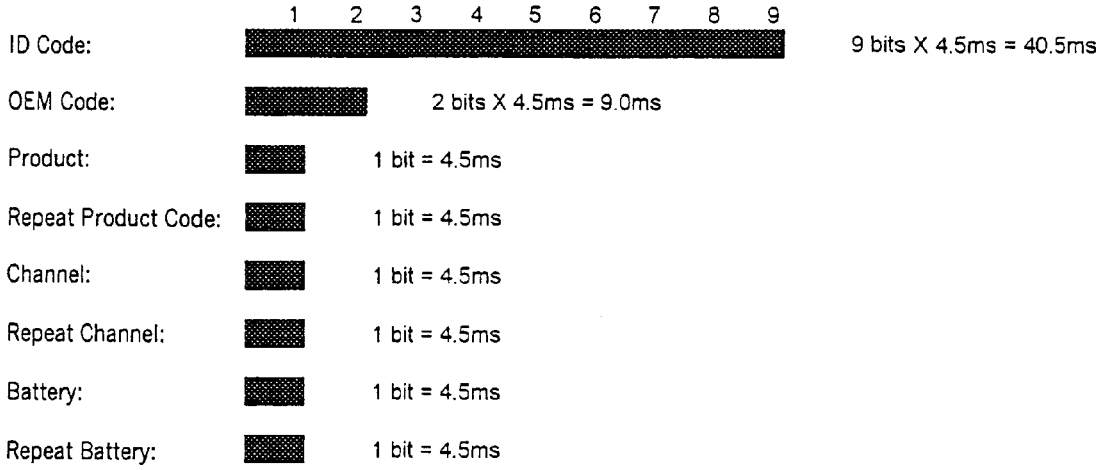
FIG. 3 shows the ID code, original equipment manufacturer (OEM) code, product code, repeat product code, channel code, repeat channel code, battery code and repeat battery code of the transmission protocol used by the present invention.

Each data stream includes a preamble (as shown in FIG. 2), ID code, OEM code, product code, repeat product code, channel code, repeat channel code, battery code and repeat battery code (as shown in FIG. 3). The data stream is designed with four quadric (refer to FIG. 4) as the basis except the preamble and without any synchronization. Therefore, the preamble with four consecutive pulses is there to ease the decoding from the receiver or decoder device.

Figure 4:
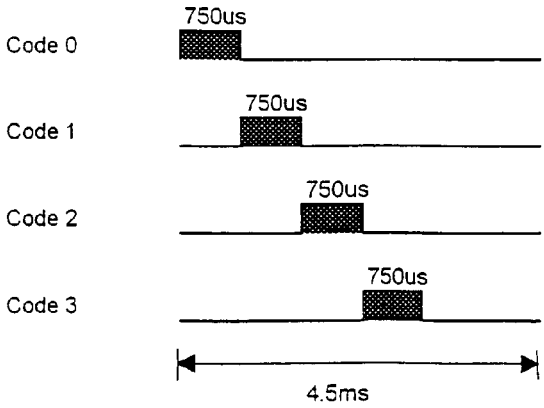
FIG. 4 shows the four quadric transmission protocol used by the present invention.

The quadric code format (refer to FIG. 4) makes the protocol more efficient than traditional binary code format. As shown in FIG. 4, the receiver or decoder device can convert one data bit as either code 0, 1, 2 or 3 depending on the location of the pulse. By traditional binary code format, it will take two pulses to make four different data. If count from FCC average transmission power regulation in 100 ms, the quadric data format in this invention can help the design to gain extra power limit of around 50%. The ID code is designed and set when the ASIC is made. By controlling the serial number and associating with electrified test probes, the circuit inside the ASIC is fused with different ID code or address code during wafer or dice testing process of IC manufacturing. Each ASIC is thus provided with a unique ID code as identity recognition. It further ensures that the receiver or decoder device, once programmed with the known ID code(s), would not receive interference from any other ID code that is not pre-programmed. The ID code is unique and is fixed with a total of 266, 144 combinations with the present invention. This is quite different from that of traditional design, which takes eight positions DIP-switch to form a total of 256 combinations. These prior art combinations are easily received with interference from neighbors or tampering by an intruder who is accessible to the same design.

The OEM code content was determined by the Input/Output (I/O) pins 8, 9 and 10 to form a total of eight selections. It is useful to allow different OEM customers in the same market to share the same protocol but without any interference from each other when the OEM code is set during product manufacturing. The receiver or decoder device would verify the OEM code against the same pre-programmed data to EEPROM to differentiate several alerting systems to co-exist in the same market without interacting to each other. When the receiver or decoder device finds that the input code does not match the pre-programmed data, it will ignore the code and the interference will be invalid.

These OEM codes can also be used differently as it may be re-defined by the receiver of the alerting system, if required.

Figure 5:
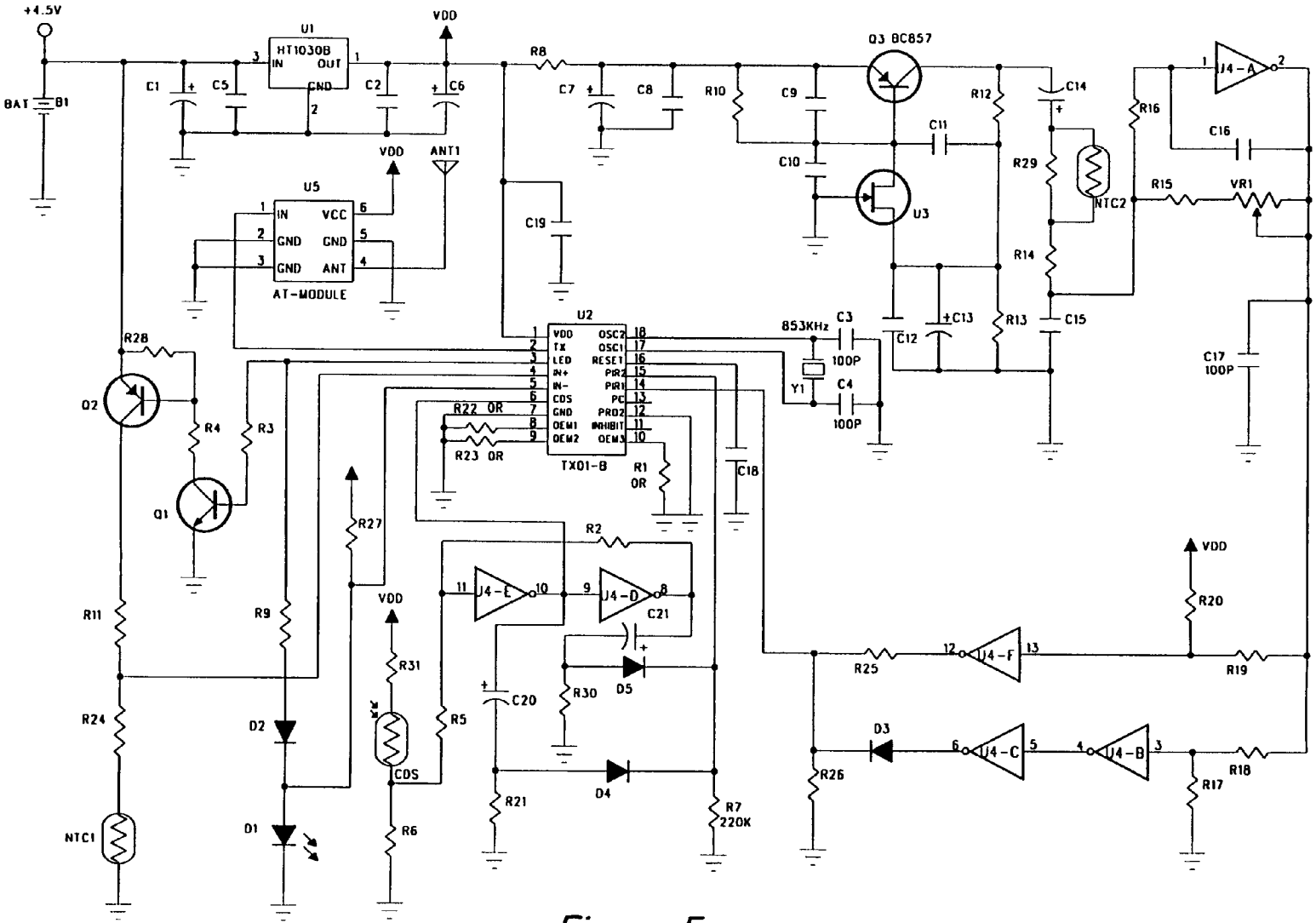
FIG. 5 shows a circuit diagram of passive infrared (PIR) transmitter according to the present invention.
Figure 6:
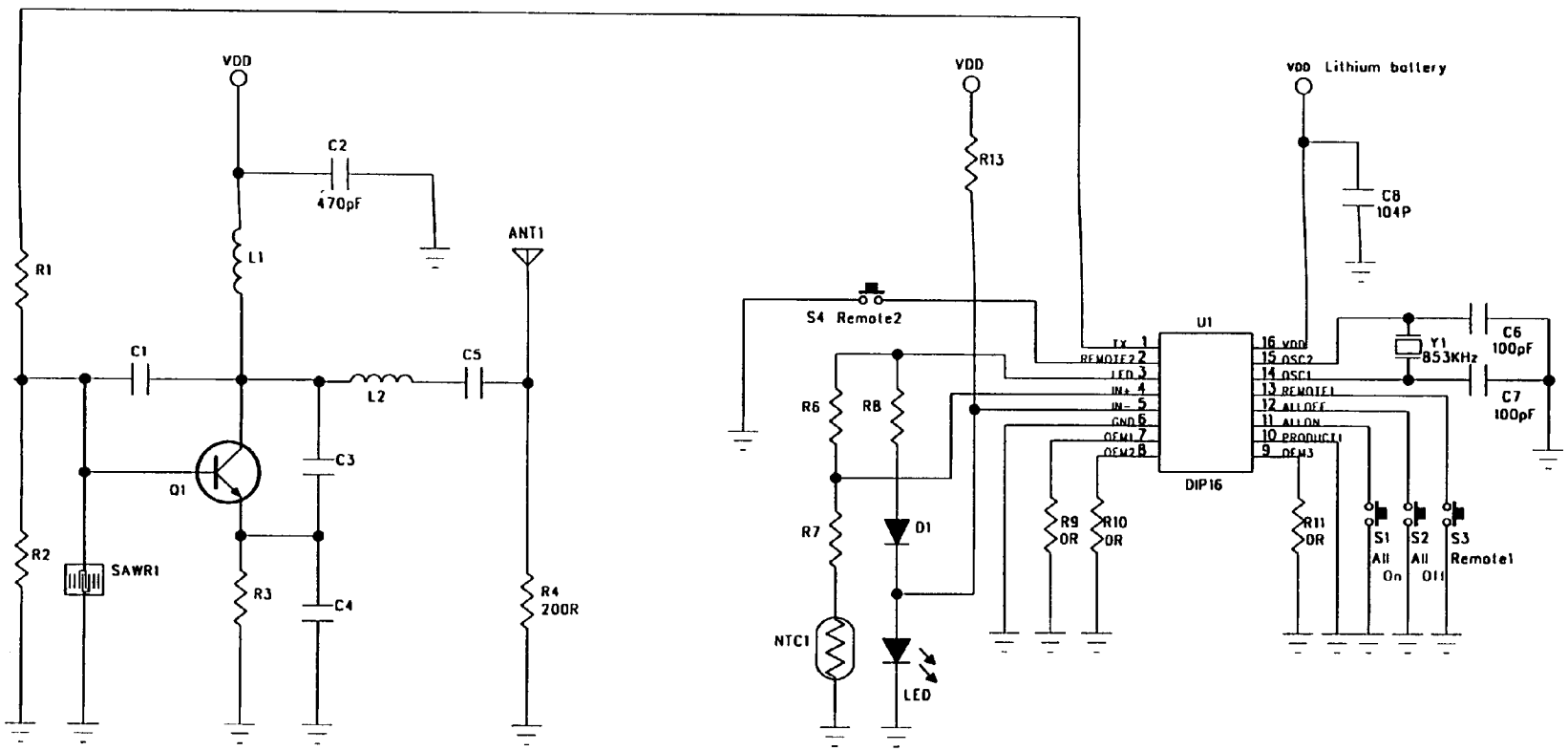
FIG. 6 shows a circuit diagram of remote transmitter according to the present invention.
Figure 7:
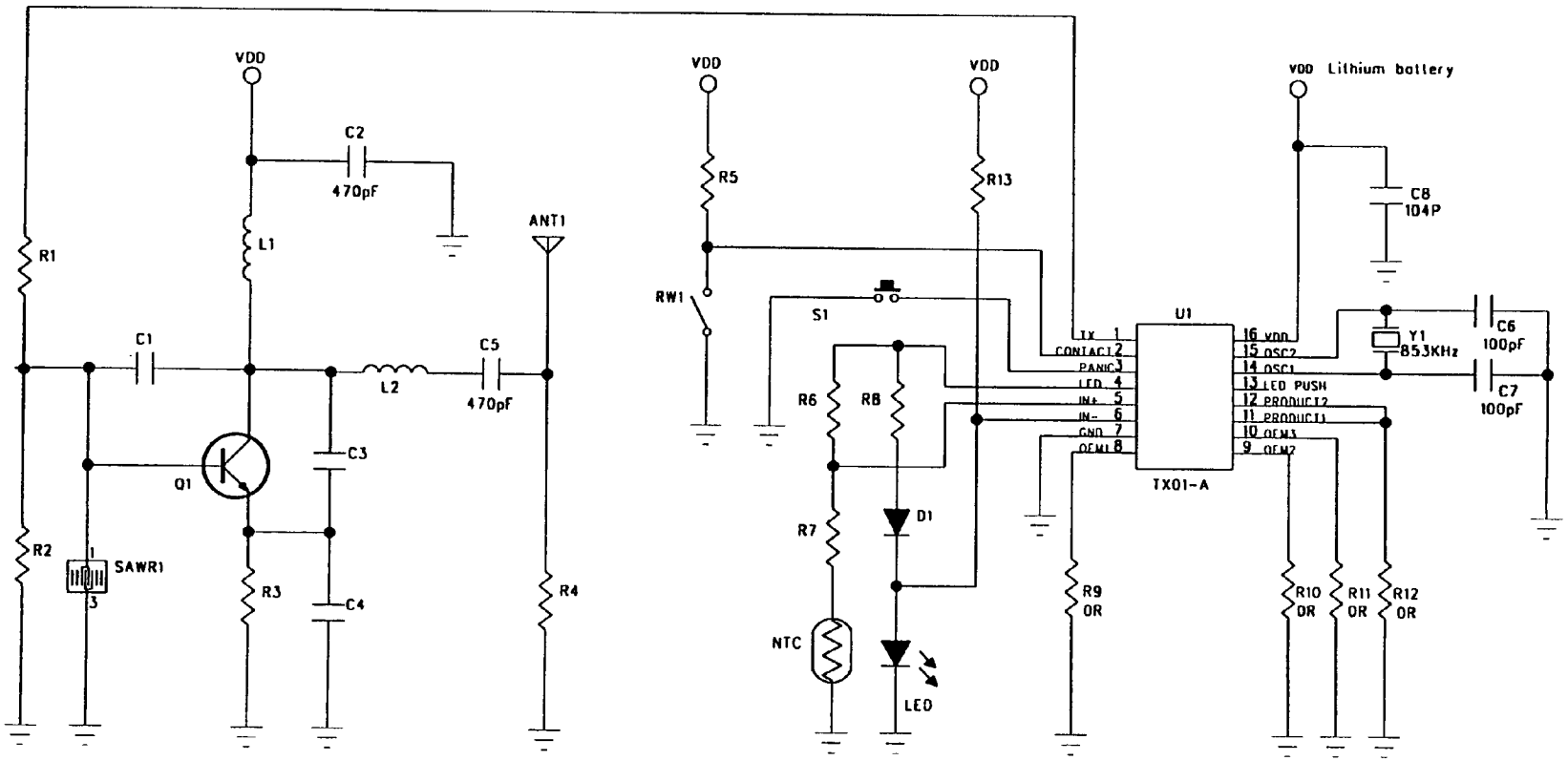
FIG. 7 shows a circuit diagram of contact transmitter according to the present invention.

The product code is determined by the I/O pins 11 and 12 to form a total of four different combinations. For example, a. "0" as Door Push TX, b. "1" as PIR TX (refer to FIG. 5, c. "2" as Remote TX (refer to FIG. 6), and d. "3" as Contact TX (refer to FIG. 7).

Different product codes will provide different features and functions depending on the presentation of the receiver itself and they can be re-defined by the receiver of the alerting system, if required.

There is a repeat product code, which is exactly the same as the product code, acting as parity check. If both the codes are different, the receiver will terminate the decoding process during its normal operation. The repeat product code can be re-defined as different from the above by the receiver of alerting system, if required.

The channel code is given automatically when the ASIC is activated. Referring to FIGS. 1, 5, 6 and 7, although the diagrams looked different, they are using the same ASIC. Associated with the product code, the channel code has the following different means:

a. Product code "0": Two channel codes are given as "0" for LED Push when activation comes from pin 13; "1" for Main Push when activation comes from pin 3 (refer to FIG. 1).

b. Product code "1": Four channel codes are given as "0" for PIR Day 1 when activation comes from pin 14 and pin 6 is at low level (refer to FIG. 5); "1" for PIR Night 1 when activation comes from pin 14 and pin 6 is at high level; "2" for PIR Day 2 when activation comes from pin 15 and pin 6 is at low level; "3" for PIR Night 2 when activation comes from pin 15 and pin 6 is at high level.

c. Product code "2": Four channel codes are given as "0" for Remote 1 when activation comes from pin 13 (refer to FIG. 6); "1" for Remote 2 when activation comes from pin 2; "2" for Remote all ON when activation comes from pin 11; "3" for Remote all OFF when activation comes from pin 12.

d. Product code "3": Three channel codes are given as "0" for panic button when activation comes from pin 3 (refer to FIG. 7); "1" for Contact ON when activation from pin 2 changes status from OFF to ON; "2" for Contact OFF when activation from pin 2 changes status from ON to OFF.

Each channel code provides different features and functions according to the presentation of the receiver itself and can be re-defined by each receiver, if required.

The repeat channel code is exactly the same as the channel code acting as parity check. If both the codes are different, the receiver will terminate the decoding processing during its normal operation. The repeat channel code can also be re-defined as different from the above by the receiver of the alerting system, if required.

During code transmission period, the ASIC will also detect the battery voltage level through operations among pins 4, 5 and 6 (refer to FIG. 1). Pin 4 acts as the switch to provide power for both the divider and the LED. Relays R6 and R7 act as the voltage divider. A negative temperature coefficient (NTC) resistor is used to compensate the voltage difference, when temperature changes, and maintains the accuracy of the voltage detection. Relay R8, diode D1 and the LED also act as the voltage divider and the transmission indication when the LED is lit. When the battery is new, the voltage level at pin 5 will be greater than at pin 6 and the battery code will be assigned as "0"; or the battery code will be assigned as "1" if the voltage level at pin 5 is less than at pin 6.

The repeat battery code is assigned as the same as the battery code. The repeat battery code can also be re-defined as different from the above by the receiver of the alerting system, if required.

Figure 8:
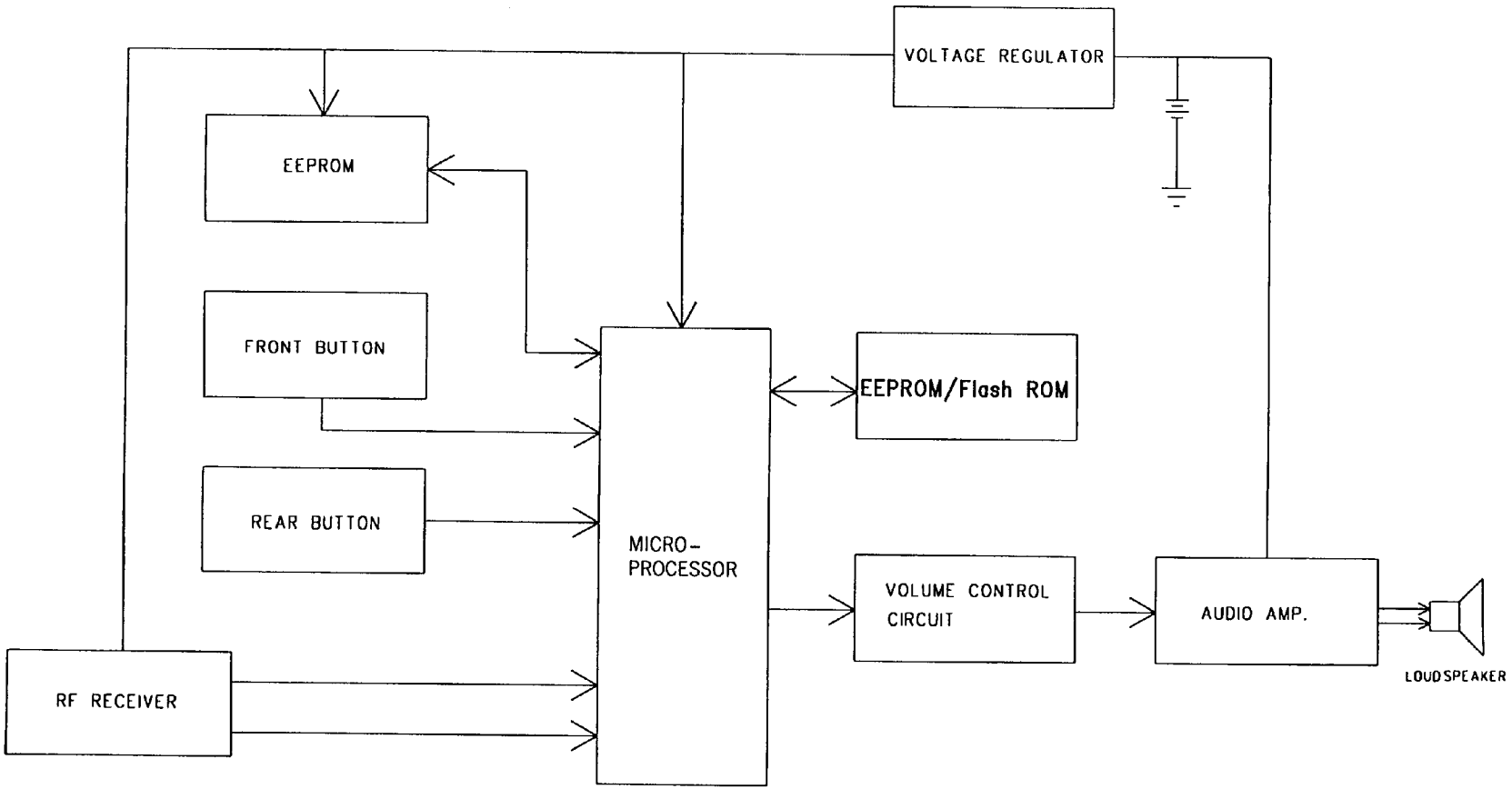
FIG. 8 shows a block diagram of a RF receiver according to the present invention.

Once the receiver (refer to FIG. 8) picks up the data streams from the air through its RF receiver, it will immediately convert the data streams into digital form and starts checking the codes one by one. If the codes are legitimate and the receiver is newly purchased or without pre-programming with any valid transmitter, the receiver will make a response to the transmitter and program the received data stream in the EEPROM as its identity. This 'automatic' programming sequence is time bound. In general, it is intelligent enough to eliminate the need of manually 'programming' the receiver by the user if default function is agreeable. Nevertheless, manual programming provision is made to allow for changes such as alternate functional settings, adding additional transmitter(s) or encoder device (s) at a later stage to the system, or to re-program system configurations, and so on, all with the assistance of various functional provisions provided by the receiver. Once the ID data stream is stored in the receiver, it will be safely secured in the EEPROM even if power supply of the receiver is removed. Thereafter, when the receiver picks up a data stream from the air, the stored ID data stream in the receiver or decoder device will be recalled for counter-checking. The receiver or decoder device only responds to the transmitter or encoder device when the ID code, the OEM code, the product code and the channel code are matching. With the learning features associated with the receiver or decoder device, the receiver or decoder device will not make any false response to any transmitter or encoder device not pre-programmed to the receiver or decoder device. Preferably, a microprocessor with a built-in flash ROM can be used for ID code storage since the memory contents can be programmed and will not be lost or changed due to power supply interruptions.

The invention claimed is:

1. A general short-range remote control system comprising:

at least one receiver device;

at least one transmitter device adapted to communicate with the at least one receiver device, the transmitter device having a factory pre-set communication protocol that includes data arranged in a four quadric or higher format, the communication protocol adapted to remain unchanged in response to power supply interruption;

the receiver device including a memory device, the memory of which will not change due to power supply interruption and adapted to be read or written or re-written to store a quadric or higher ID code from the transmitter device during a programming mode;

wherein the transmitter device is adapted to generate a 1.2 second data stream including the quadric or higher ID code to be received by the receiver, the 1.2 second data stream conforming to the communication protocol and including data arranged in a four quadric or higher format; and a microprocessor in the receiver that is adapted to respond if the quadric or higher ID code received from the transmitter device matches a quadric or higher ID code stored in the receiver.

2. The system of claim 1, wherein the communication protocol comprises an ID code, an OEM code, a product code, a repeat product code, a channel code, a repeat channel code, a battery code and a repeat battery code.

3. The system of claim 1, wherein the transmitter device includes an application specific integrated circuit (ASIC).

4. The system of claim 3, wherein the quadric or higher ID code is fused into the transmitter during IC manufacturing.

5. The system of claim 1, wherein the transmitter device includes a microprocessor having a built-in a flash ROM or a built-in external EEPROM.

6. The system of claim 5, wherein the quadric or higher ID code is loaded into the transmitter during IC manufacturing.

7. The system of claim 1, wherein the microprocessor in the receiver is adapted to interface with an EEPROM or flash ROM, such that the receiver can be programmed by depressing buttons on the receiver.

8. The system of claim 1, wherein the receiver interprets a channel code and a product code within the data stream to determine the response.

* * * * *